US006607093B1

(12) United States Patent
Morad et al.

(10) Patent No.: US 6,607,093 B1
(45) Date of Patent: Aug. 19, 2003

(54) SPRING-LOADED PAPER TOWEL TRACK ADAPTER FOR A RECESSED PAPER TOWEL DISPENSER

(75) Inventors: Fred I. Morad, Toluca Lake, CA (US); James G. Horian, Newport Beach, CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 26 days.

(21) Appl. No.: 10/041,067

(22) Filed: Dec. 28, 2001

(51) Int. Cl.[7] ..... B65H 1/00
(52) U.S. Cl. ..... 221/33; 221/44; 221/45
(58) Field of Search ..... 221/33, 44, 46, 221/47, 48, 51, 61; 312/50, 60

(56) References Cited

U.S. PATENT DOCUMENTS 4,678,099 A * 7/1987 Matsui ..... 221/48
4,811,878 A * 3/1989 Horinchi ..... 221/46 X
5,950,863 A * 9/1999 Schutz et al. ..... 221/46 X
6,354,462 B1 * 3/2002 Conran et al. ..... 221/45
2001/0020624 A1 * 9/2001 Hubanks et al. ..... 221/45

* cited by examiner

*Primary Examiner*—David H. Bollinger
(74) *Attorney, Agent, or Firm*—Thomas I. Rozsa; Tony D. Chen

(57) ABSTRACT

A spring-loaded wing paper towel track adapter for accommodating shorter width paper towels within a conventional recessed paper towel dispenser and waste receptacle, including a corresponding curved bottom wall which matches the curved bottom wall of the recessed paper towel dispenser, and two opposing sidewalls integrally molded with the bottom wall and extending upwardly therefrom. The curved bottom wall has a transverse dispenser opening for dispensing the plurality of shorter width multifold paper towels. A spring-loaded wing portion is respectively integrally molded by a living hinge to each respective end of the opposing sidewall of the body, where the spring-loaded wing portion can be folded outwardly and downwardly parallel to each opposing sidewall for shipping of the paper towel track adapter and spring outwardly and upwardly to automatically center the dispenser opening of the body to the dispenser opening of the recessed paper towel dispenser for dispensing the plurality of shorter width paper towels therefrom.

12 Claims, 2 Drawing Sheets

SPRING-LOADED PAPER TOWEL TRACK ADAPTER FOR A RECESSED PAPER TOWEL DISPENSER

BACKGROUND OF THE INVENTION

1. Field of the Invention

The present invention relates generally to the field of paper towel dispensers. More particularly, the present invention relates to the field of paper towel track adapters for accommodating an enlarged recess opening of a paper towel dispenser.

2. Description of the Prior Art

Specifically, C-fold or multifold paper towel manufacturers have recently been producing shorter width C-fold or multifold paper towels for a conventional recessed paper towel dispenser and waste receptacle. These shorter width paper towels are too short for the paper towel dispense opening of the paper towel dispenser. The problem with the shorter width paper towels is that it moves laterally within the paper towel dispenser, and thereby makes it difficult to pull out the paper towel from the paper towel dispense opening of the dispenser. To solve this problem, prior art adapters have been utilized for accommodating the shorter width paper towels. However, most of the prior art adapters are too complicated to assemble within the paper towel dispenser and they do not center the paper towels within the paper towel dispenser opening.

It is desirable to provide a spring-loaded paper towel track adapter with the capability of rapidly adjusting to the paper towel compartment of a conventional recessed paper towel dispenser and centering the paper towels relative to the dispenser opening for dispensing the paper towels. It is also desirable to provide a paper towel track adapter with living wing hinges so that the living wing hinges can be folded for shipping the paper towel track adapter and unfolded for quick installation within the paper towel dispenser in a much more efficient way.

SUMMARY OF THE INVENTION

The present invention is a unique paper towel track adapter for accommodating shorter width paper towels within a conventional recessed paper towel dispenser.

It is an object of the present invention to provide a paper towel track adapter so that it can accommodate shorter width paper towels within a conventional recessed paper towel dispenser.

It is an additional object of the present invention to provide a paper towel track adapter having living wing hinges so that the living wing hinges can be folded for shipping the paper towel adapter and unfolded for quick installation within a conventional recessed paper towel dispenser.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
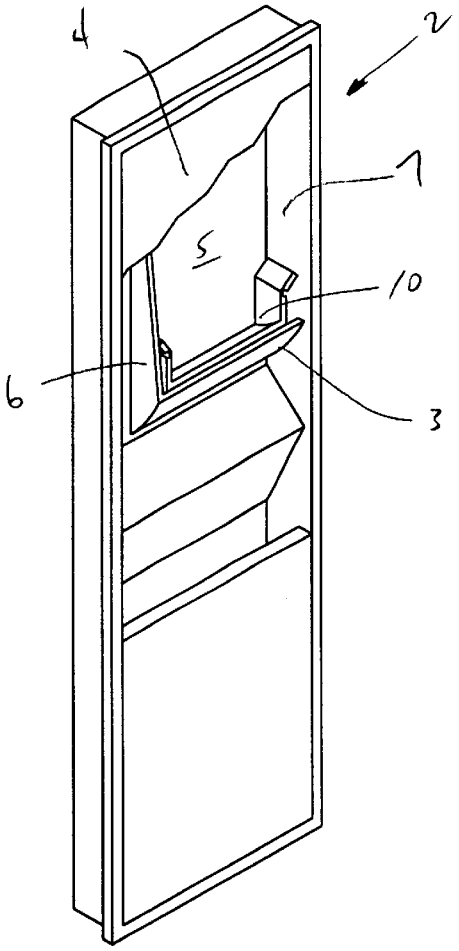
FIG. 1 is a perspective view of a typical recessed paper towel dispenser including a waste receptacle with the upper portion thereof broken away to better illustrate the structural relationship of the present invention spring-loaded paper towel track adapter.
Figure 2:
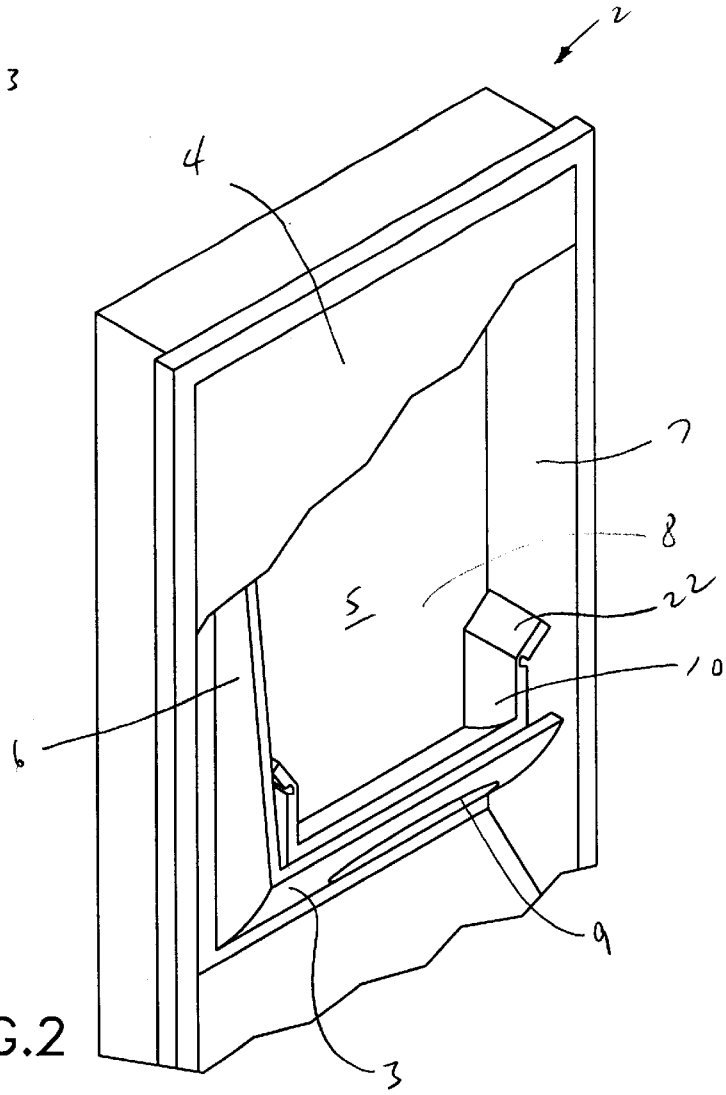
FIG. 2 is an enlarged perspective view of the present invention spring paper towel track in its position of use.

Referring to FIGS. 1 and 2, there is shown at 2 a typical recessed paper towel dispenser including a waste receptacle with the upper portion thereof broken away to show the present invention spring-loaded wing paper towel track adapter 10. The present invention paper towel track adapter 10 is used in conjunction with the recessed paper towel dispenser 2 which includes a curved bottom wall 3, a front wall 4, a rear wall 5 and two opposing sidewalls 6 and 7. All of the walls form a paper towel compartment 8 to confine a plurality of shorter width multifold paper towels (not shown) therein. The bottom wall 3 has an enlarged paper towel dispenser opening 9 which is too large of an opening to properly dispense the plurality of shorter width multifold paper towels which are approximately 8.10 inches in width.

Referring to FIGS. 3, 4, 5, and 6, there is shown at 10 the present invention spring-loaded wing paper towel track adapter which includes a body 12 being conformed to the paper towel compartment 8 of the recessed paper towel dispenser 2. The body 12 has a width "W" which is sized to fit the plurality of shorter width paper towels. The width "W" is approximately 9.30 inches. The body 12 has a corresponding curved bottom wall 14 which matches the curved bottom wall 3 of the recessed paper towel dispenser 2, and two opposing sidewalls 16 and 18 integrally molded with the bottom wall 14 and extending upwardly therefrom. The curved bottom wall 14 has a transverse dispenser opening 20 for dispensing the plurality of shorter width multifold paper towels. The transverse dispenser opening 20 is approximately between 8.30–8.40 inches. A spring-loaded wing portion 22 is respectively integrally molded by a living hinge 24 to each respective end of an opposing sidewall 16 and 18 of the body 12, where the spring-loaded wing portion 22 can be folded outwardly and downwardly parallel to each opposing sidewall for symmetrical shaped shipping of the paper towel track adapter 10 and spring outwardly and upwardly to be automatically centered so that the dispenser opening 20 of the body 12 is positioned above and in line with the dispenser opening 9 of the recessed paper towel dispenser 2 for dispensing the plurality of shorter width paper towels therefrom. The body 12 of the paper towel track adapter 10 is positioned within the paper towel compartment 8 (see FIGS. 1 and 2), where the body 12 is automatically centered by the wing portions 22 so that the dispensing opening 20 is positioned above the dispenser opening 9 of the recessed paper towel dispenser 2 such that the plurality of shorter width towel papers can be dispensed.

Figure 3:
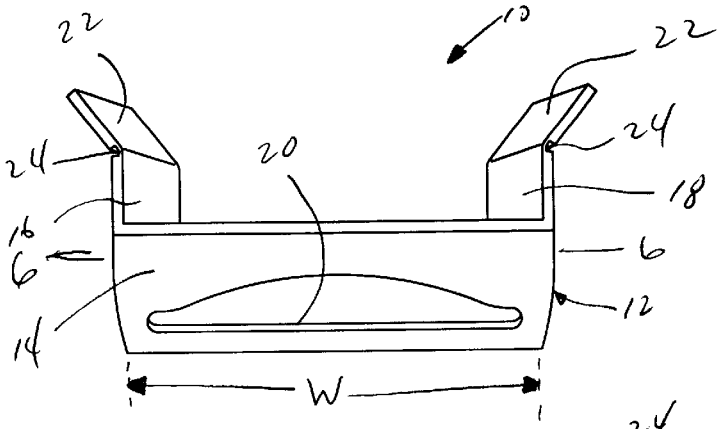
FIG. 3 is a perspective view of the present invention spring-loaded wing paper towel track adapter in its loaded condition.
Figure 4:
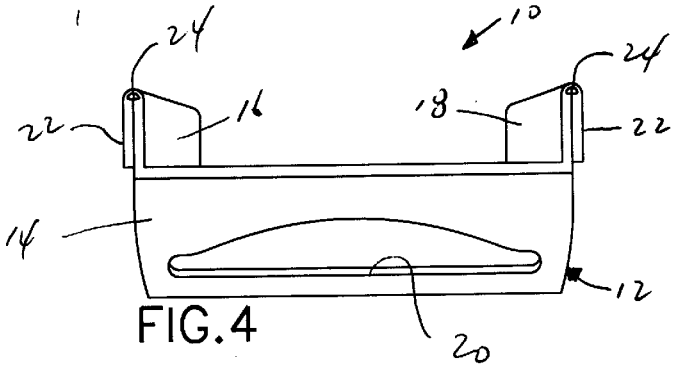
FIG. 4 is a perspective view of the present invention spring-loaded wing paper towel track adapter in its shipped condition.
Figure 5:
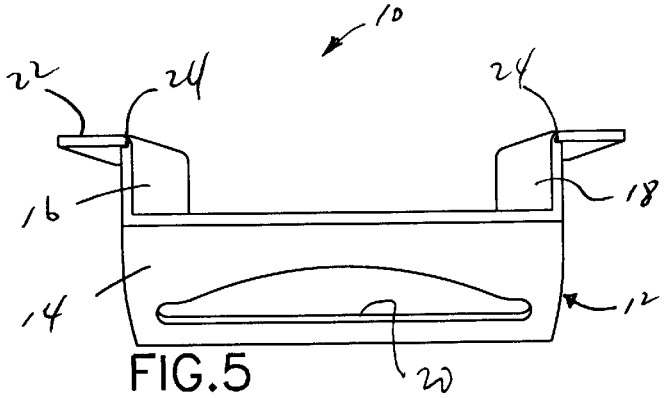
FIG. 5 is a perspective view of the present invention spring-loaded wing paper towel track adapter in its molded condition.
Figure 6:
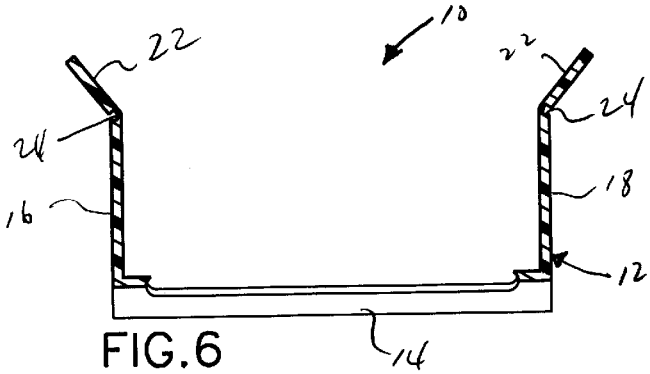
FIG. 6 is a transverse cross-sectional view of the present invention spring-loaded wing paper towel track adapter.

FIG. 3 is a perspective view of the present invention spring-loaded wing paper towel track adapter 10 in its ready to install condition. FIG. 4 is a perspective view of the present invention spring-loaded wing paper towel track adapter 10 in its shipped condition, where the wing portions 22 can be folded parallel to each opposing sidewall for symmetrical shaped shipping of the paper towel track adapter 10. FIG. 5 is a perspective view of the present invention spring-loaded wing paper towel track adapter 10 in its molded condition taken rightout of the mold.

The present invention conforms to conventional forms of manufacture or any other conventional way known to one skilled in the art, and is of simple construction and is easy to use. The manufacturing process which could accommodate the construction of the paper towel track adapter 10 may be injection, thermoform, etc. or other molding process. By way of example, the present invention paper towel track adapter 10 can be made of plastic material.

Defined in detail, the present invention is a paper towel track adapter used in conjunction with a recessed paper towel dispenser having a curved bottom wall, a front wall, a rear wall and two opposing sidewalls, all the walls forming a paper towel compartment to confine a plurality of shorter width multifold paper towels therein, the bottom wall having an enlarged paper towel dispenser opening for dispensing the plurality of multifold paper towels, the paper towel track adapter comprising: (a) a body being conformed to the paper towel compartment of the recessed paper towel dispenser and having a width which is sized to fit the plurality of shorter width paper towels, the body having a corresponding curved bottom wall and two opposing sidewalls integrally molded with the bottom wall and extending upwardly therefrom, the curved bottom wall having a dispenser opening for dispensing the plurality of shorter width multifold paper towels; and (b) a spring-loaded wing portion respectively integrally molded by a living hinge to the each respective opposing sidewall, where the spring-loaded wing portion can be folded outwardly and downwardly parallel to the each opposing sidewall for symmetrical shaped shipping of the body of the paper towel track adapter and spring outwardly and upwardly to automatically center the dispenser opening of the body to the dispenser opening of the recessed paper towel dispenser for dispensing the plurality of shorter width paper towels therefrom; (c) whereby the body of the paper towel track adapter is positioned within the paper towel compartment and the body is automatically centered so that the dispenser opening is positioned above the dispenser opening of the recessed paper towel dispenser for dispensing the plurality of shorter width towel papers.

Defined broadly, the present invention is a paper towel adapter used in conjunction with a recessed paper towel dispenser having a bottom wall, a front wall, a rear wall and two opposing sidewalls, all the walls forming a paper towel compartment to confine a plurality of shorter width multifold paper towels therein, the bottom wall having a paper towel dispenser opening for dispensing the plurality of multifold paper towels, the paper towel adapter comprising: (a) a body being conformed to the paper towel compartment of the recessed paper towel dispenser and having a width which is sized to fit the plurality of shorter width paper towels, the body having a corresponding bottom wall and two opposing sidewalls integrally formed with the bottom wall and extending upwardly therefrom, the bottom wall having a dispenser opening for dispensing the plurality of shorter width multifold paper towels; and (b) a spring-loaded wing portion respectively integrally formed by a living hinge to the each respective opposing sidewall, where the spring-loaded wing portion can be folded outwardly and downwardly parallel to the each opposing sidewall for shipping of the body of the paper towel adapter and spring outwardly and upwardly to automatically center the dispenser opening of the body to the dispenser opening of the recessed paper towel dispenser for dispensing the plurality of shorter width paper towels therefrom; (c) whereby the body of the paper towel adapter is positioned within the paper towel compartment and the body is automatically centered so that the dispenser opening is positioned above the dispenser opening of the recessed paper towel dispenser for dispensing such that the plurality of shorter width towel papers.

Defined more broadly, the present invention is a paper towel adapter used in conjunction with a recessed paper towel dispenser having a bottom wall, a front wall, a rear wall and two opposing sidewalls, all the walls forming a paper towel compartment to confine a plurality of shorter width paper towels therein, the bottom wall having a paper towel dispenser opening for dispensing the plurality of paper towels, the paper towel adapter comprising: (a) a body being conformed to the paper towel compartment of the recessed paper towel dispenser and having a width which is sized to fit the plurality of shorter width paper towels, the body having a corresponding bottom wall and two sidewalls attached to the bottom wall and extending upwardly therefrom, the bottom wall having a dispenser opening for dispensing the plurality of shorter width paper towels; and (b) a spring-loaded wing portion respectively formed by a living hinge to the each respective sidewall to automatically center the dispense opening of the body to the dispense opening of the paper towel dispenser for dispensing the plurality of shorter width paper towels therefrom; (c) whereby the body of the adapter is positioned within the paper towel compartment and the body is automatically centered by the spring-loaded wing portion of the each sidewall so that the dispenser opening is positioned above the dispenser opening of the paper towel dispenser for dispensing the plurality of shorter width towel papers.

Defined even more broadly, the present invention is an adapter used in conjunction with a paper towel dispenser having a paper towel compartment with a paper towel dispenser opening for dispensing a plurality of shorter width paper towels, the adapter comprising: (a) the adapter being conformed to the paper towel compartment of the paper towel dispenser and having a width which is sized to fit the plurality of shorter width paper towels, the adapter having a bottom wall and two sidewalls attached to the bottom wall and extending upwardly therefrom, the bottom wall having a dispenser opening for dispensing the plurality of shorter width paper towels; and (b) a wing portion respectively formed by a living hinge to the each respective sidewall to automatically center the dispenser opening of the adapter to the dispenser opening of the paper towel dispenser for dispensing the plurality of shorter width paper towels therefrom; (c) whereby the adapter is positioned within the paper towel compartment and the body is automatically centered by the wing portion of the each respective sidewall so that the dispenser opening is positioned above the dispenser opening of the paper towel dispenser for dispensing the plurality of shorter width towel papers.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A paper towel track adapter used in conjunction with a recessed paper towel dispenser having a curved bottom wall, a front wall, a rear wall and two opposing sidewalls, all the walls forming a paper towel compartment to confine a plurality of shorter width multifold paper towels therein, the bottom wall having an enlarged paper towel dispenser opening for dispensing the plurality of multifold paper towels, the paper towel track adapter comprising:

a. a body being conformed to said paper towel compartment of said recessed paper towel dispenser and having a width which is sized to fit said plurality of shorter width paper towels, the body having a corresponding curved bottom wall and two opposing sidewalls integrally molded with the bottom wall and extending upwardly therefrom, the curved bottom wall having a dispenser opening for dispensing said plurality of shorter width multifold paper towels; and b. a spring-loaded wing portion respectively integrally molded by a living hinge to said each respective opposing sidewall, where the spring-loaded wing portion can be folded outwardly and downwardly parallel to said each opposing sidewall for symmetrical shaped shipping of said body of said paper towel track adapter and spring outwardly and upwardly to automatically center said dispenser opening of said body to said dispenser opening of said recessed paper towel dispenser for dispensing said plurality of shorter width paper towels therefrom;

c. whereby said body of said paper towel track adapter is positioned within said paper towel compartment and said body is automatically centered so that said dispenser opening is positioned above said dispenser opening of said recessed paper towel dispenser for dispensing said plurality of shorter width towel papers.

2. The paper towel track adapter in accordance with claim 1, wherein said body is made of plastic material.

3. A paper towel adapter used in conjunction with a recessed paper towel dispenser having a bottom wall, a front wall, a rear wall and two opposing sidewalls, all the walls forming a paper towel compartment to confine a plurality of shorter width multifold paper towels therein, the bottom wall having a paper towel dispenser opening for dispensing the plurality of multifold paper towels, the paper towel adapter comprising:

a. a body being conformed to said paper towel compartment of said recessed paper towel dispenser and having a width which is sized to fit said plurality of shorter width paper towels, the body having a corresponding bottom wall and two opposing sidewalls integrally formed with the bottom wall and extending upwardly therefrom, the bottom wall having a dispenser opening for dispensing said plurality of shorter width multifold paper towels; and b. a spring-loaded wing portion respectively integrally formed by a living hinge to said each respective opposing sidewall, where the spring-loaded wing portion can be folded outwardly and downwardly parallel to said each opposing sidewall for shipping of said body of said paper towel adapter and spring outwardly and upwardly to automatically center said dispenser opening of said body to said dispenser opening of said recessed paper towel dispenser for dispensing said plurality of shorter width paper towels therefrom;

c. whereby said body of said paper towel adapter is positioned within said paper towel compartment and said body is automatically centered so that said dispenser opening is positioned above said dispenser opening of said recessed paper towel dispenser for dispensing such that said plurality of shorter width towel papers.

4. The paper towel adapter in accordance with claim 3, wherein said body is made of plastic material.

5. A paper towel adapter used in conjunction with a recessed paper towel dispenser having a bottom wall, a front wall, a rear wall and two opposing sidewalls, all the walls forming a paper towel compartment to confine a plurality of shorter width paper towels therein, the bottom wall having a paper towel dispenser opening for dispensing the plurality of paper towels, the paper towel adapter comprising:

a. a body being conformed to said paper towel compartment of said recessed paper towel dispenser and having a width which is sized to fit said plurality of shorter width paper towels, the body having a corresponding bottom wall and two sidewalls attached to the bottom wall and extending upwardly therefrom, the bottom wall having a dispenser opening for dispensing said plurality of shorter width paper towels; and b. a spring-loaded wing portion respectively formed by a living hinge to said each respective sidewall to automatically center said dispense opening of said body to said dispense opening of said paper towel dispenser for dispensing said plurality of shorter width paper towels therefrom;

c. whereby said body of said adapter is positioned within said paper towel compartment and said body is automatically centered by said spring-loaded wing portion of said each sidewall so that said dispenser opening is positioned above said dispenser opening of said paper towel dispenser for dispensing said plurality of shorter width towel papers.

6. The paper towel adapter in accordance with claim 5, wherein said body is made of plastic material.

7. The paper towel adapter in accordance with claim 5, wherein said respective wing portion of said each respective sidewall can be folded outwardly and downwardly parallel to said each sidewall for shipping of said body of said adapter and spring outwardly and upwardly to automatically center said dispenser opening of said body to said dispenser opening of said paper towel dispenser.

8. The paper towel adapter in accordance with claim 5, wherein said plurality of shorter width paper towels are multifold paper towels.

9. An adapter used in conjunction with a paper towel dispenser having a paper towel compartment with a paper towel dispenser opening for dispensing a plurality of shorter width paper towels, the adapter comprising:

a. said adapter being conformed to said paper towel compartment of said paper towel dispenser and having a width which is sized to fit said plurality of shorter width paper towels, said adapter having a bottom wall and two sidewalls attached to the bottom wall and extending upwardly therefrom, the bottom wall having a dispenser opening for dispensing said plurality of shorter width paper towels; and b. a wing portion respectively formed by a living hinge to said each respective sidewall to automatically center said dispenser opening of said adapter to said dispenser opening of said paper towel dispenser for dispensing said plurality of shorter width paper towels therefrom;

c. whereby said adapter is positioned within said paper towel compartment and said body is automatically centered by said wing portion of said each respective sidewall so that said dispenser opening is positioned above said dispenser opening of said paper towel dispenser for dispensing said plurality of shorter width towel papers.

10. The adapter in accordance with claim 9, wherein said adapter is made of plastic material.

11. The adapter in accordance with claim 9, wherein said respective wing portion of said each respective sidewall can be folded outwardly and downwardly parallel to said each sidewall for shipping of said adapter and spring outwardly and upwardly to automatically center said dispenser opening of said adapter to said dispenser opening of said paper towel dispenser.

12. The adapter in accordance with claim 9, wherein said plurality of shorter width paper towels are multifold paper towels.

* * * * *